United States Patent [19]

Sugioka et al.

[11] Patent Number: 4,978,082

[45] Date of Patent: Dec. 18, 1990

[54] BOBBIN HOLDER

[75] Inventors: Takami Sugioka; Toshiyuki Ueno, both of Matsuyama; Toshihiro Yudate, Ehime; Koji Kobayashi, Matsuyama, all of Japan

[73] Assignee: Teijin Seiki Co., Ltd., Osaka, Japan

[21] Appl. No.: 326,883

[22] Filed: Mar. 20, 1989

[30] Foreign Application Priority Data

Mar. 29, 1988 [JP] Japan ..... 63-75512
Apr. 30, 1988 [JP] Japan ..... 63-108417

[51] Int. Cl.[5] ..... B65H 54/547
[52] U.S. Cl. ..... 242/46.4
[58] Field of Search ..... 242/46.4, 46.2, 46.3, 242/46.5, 46.6, 72 R, 72.1

[56] References Cited

U.S. PATENT DOCUMENTS 3,977,616 8/1976 Owens et al. ..... 242/46.4
4,142,690 3/1979 Karle et al. ..... 242/46.4
4,241,883 12/1980 Benin ..... 242/46.4
4,323,835 11/1980 Benin ..... 242/46.4
4,458,850 7/1984 Sugioka et al. ..... 242/46.4

*Primary Examiner*—Stanley N. Gilreath
*Attorney, Agent, or Firm*—Burgess, Ryan & Wayne

[57] ABSTRACT

A bobbin holder comprises a rotatable support member, a plurality of bobbin holding devices inserted onto the rotatable support member, and at least one cylindrical member inserted onto the rotatable support member and engaging with the bobbin holding device, so that bobbin holding devices are expanded so as to hold bobbins. A main compression member for radically expanding the bobbin holding devices is disposed at one end of the bobbin holder. At least one supplementary compression member for supplementing expansion force of the main compression member is disposed at an intermediate portion between a bobbin holding device located at the end where the main compression member is disposed and another bobbin holding device located at an opposite end.

3 Claims, 9 Drawing Sheets

FIG. 12-a

BOBBIN HOLDER

BACKGROUND OF THE INVENTION

The present invention relates to a bobbin holder, especially, a bobbin holder installed in a yarn winding apparatus for winding a synthetic yarn at a high speed.

The present invention specifically relates to a bobbin holder which can smoothly and surely hold a bobbin.

Further, the present invention relates to a bobbin holder installed in a yarn winding apparatus which can simultaneously wind a plurality of yarns.

In conventional bobbin holders, as described in Japanese Utility Model Application Laid-open No. Sho 60-1766 and U.S. Pat. No. 4,458,850, a ring-like elastomeric member inserted onto a rotatable cylindrical support is compressed in an axial direction so that a bobbin is held.

In such a bobbin holder, a large force is necessary because the ring-like elastomeric member is compressed in an axial direction and is deformed.

The elastomeric member is compressed by a spring disposed at a front end of the rotatable cylindrical support. Because of frictional resistance between the elastomeric member and the support or bobbins, the force for compressing the elastomeric member at the rear side of the support is smaller that for compressing the elastomeric member at the front side of the support, and accordingly, the elastomeric member located at the rear side is hard to be deformed. Therefore, there occurs a problem that the insides of bobbins are not held completely, and that accordingly, the bobbins are loosened during winding operation and vibrate.

Further, in a conventional bobbin holder for holding a plurality of bobbins described in the above-mentioned U.S. Pat. No. 4,458,850, compressed air in a cylinder chamber is exhausted when the bobbins are held. As a result, the bobbin holding devices and the elastomeric members, which are alternately inserted on the rotatable support member, are compressed by compression means, such as a coned disc spring. Thus, the bobbin holding device disposed at the rear end of the rotatable support member is compressed via the bobbin holding device disposed at the front end and the cylindrical member.

Accordingly, the bobbin holding device disposed at the front end is subjected to sliding resistance between the rotatable support member and the cylindrical member, sliding resistance between the bobbin holding device and the rotatable support member, and sliding resistance between the bobbin holding device and the inner surface of the bobbin, as well as the force for deforming the rubber ring located near the rear end when the bobbin holding device is made of a rubber ring. As a result, the force acting on the bobbin holding device located near front end is larger than the force acting on the bobbin holding device located near rear end.

Therefore, the bobbin holding device located near front end holds the bobbin earlier than the bobbin holding device located near rear end does. Consequently, the force transmitted to the bobbin holding device located near the rear end becomes small. Accordingly, the bobbin holding device located near the rear end is not completely in contact with the inner surface of the bobbin nor the outer surface of the rotatable support member, and the force for holding the bobbins become insufficient.

As a result of the insufficient bobbin holding force, the bobbins may vibrate, and accordingly, the winding apparatus may generate noise and is dangerous in some cases. In addition, bearings supporting the rotatable support member may be damaged because of the vibration. Furthermore, the yarns which are wound on the bobbin may be rubbed between the bobbin surfaces and a contact roller because of the vibration of the bobbins, and accordingly, the yarn quality is reduced.

Besides, during the yarn winding operation, the chucking portion of the bobbin holder may be deviated because of the weight of the wound packages, and the above-described vibration is enhanced, and accordingly, the wound package may be deformed.

In the meantime, the amount of yarn wound on a bobbin is recently increasing, and the number of bobbins held on a single bobbin holder is also increasing, and correspondingly, the numbers of the bobbin holding devices and the cylindrical members increase. Accordingly, the above-described insufficient bobbin holding force and deformation of the wound package become remarkable.

As described in other prior art, such as Japanese Utility Model application Laid-open No. Sho 57-96144 or Japanese Utility Model application Laid-open No. Sho 50-142836, there, has been known a bobbin holder which comprises a pair of frustoconical members each having an inclined portion and a cylindrical member having an inclined inner surface, and the the pair of frustoconical members axially press the cylindrical member so that the outer surface of the cylindrical member is kept in close contact with the inner surface of the bobbin.

In these bobbin holders, the outer surface of the cylindrical member is always in close contact with the inner surface of the bobbin when a yarn is wound on the bobbin. However, the cylindrical member is formed in one body and therefore is rigid. Accordingly, the diameter of the cylindrical member will not be easily changed, and accordingly, the inner surface of the cylindrical member is spaced from the rotatable support member. During the winding operation, small vibration may be caused because of ribboning of the wound yarn or unbalance of the wound yarn package.

Further, the weight of the package and the contacting forces are applied to the bobbin holder under the small vibration, the portion where the rotatable support member and the cylindrical member engage with each other is beaten. Accordingly, clogging between the rotatable support member and the cylindrical member may occur. Consequently, the cylindrical member does not work well, and therefore, there occur problems that bobbins cannot be held well or that the held bobbins cannot be released.

SUMMARY OF THE INVENTION

It is an object of the present invention to obviate the above-described problems.

It is another object to provide a bobbin holder which can securely hold a bobbin, which is free from vibration and deformation of a yarn package during the winding operation, which can lower the noise, which can prolong the life of bearings supporting a rotatable support member, which can be operated in safety and which can wind a yarn with high quality.

According to the present invention, the above-described objects are achieved by a bobbin holder which comprises a rotatable support member, a device, inserted onto the rotatable support member, for holding a bobbin, and a cylindrical member inserted onto the rotatable support member and engaging with the bobbin holding device, the bobbin holding device comprising:

a first inclined member which has an inner surface engaging with the rotatable support member and an inclined outer surface; and a second inclined member which has an inclined surface engaging with the first inclined member and an outer surface engaging with an inner surface of a bobbin, the first inclined member being substantially divided into a plurality of small pieces in a circumferential direction, the second inclined member comprising a plurality of pieces substantially separated in a circumferential direction, the pieces of the second inclined member engaging with the small pieces of the first inclined member, respectively, when the inclined surfaces being engaged with each other, whereby the first inclined member is pressed in an axial direction by means of the cylindrical member so that the bobbin holding device is expanded in a radial direction so as to hold the bobbin.

Further, the present invention provides a bobbin holder which comprises a rotatable support member, a plurality of devices, inserted onto the rotatable support member, for holding bobbins, and at least one cylindrical member inserted onto the rotatable support member and engaging with the bobbin holding devices, so that the bobbin holding devices are expanded in a radial direction so as to hold bobbins, wherein:

a main compression member for compressing the bobbin holding devices in an axial direction is disposed at one end of the bobbin holder, at least one supplementary compression member for supplementing the compression force of the main compression member is disposed at an intermediate portion between a bobbin holding device located at the end where the main compression member is disposed and another bobbin holding device located at an opposite end, and the number of the supplementary compression members is less than that of the bobbin holding devices.

In addition, as described in the specific embodiments, both the above-described features may be simultaneously applied to a single bobbin holder of the present invention.

According to the present invention, the first and second inclined members are substantially divided into pieces in a circumferential direction.

Accordingly, when the bobbin holder holds a bobbin, the first and second inclined members engage with each other at the inclined surfaces in a pair, and further, the first inclined member comes in close contact with the rotatable support member, and the second inclined member comes in close contact with the inner surface of the bobbin. As a result, the bobbin is securely held, and the small vibration does not occur because the bobbin becomes coaxial with the bobbin holder.

When the bobbin is released, the inclined surfaces of a pair of inclined members, the first inclined member and the rotatable support member, and the second inclined member and the inner surface of the bobbin engage with each other in a spaced relationship. Accordingly, the bobbin becomes free and can be readily removed from the bobbin holder.

Further, according to the present invention, a main compression member for compressing the bobbin holding devices is disposed at one end of the bobbin holder, at least one supplementary compression member for supplementing the compression force of the main compression member is disposed at an intermediate portion between a bobbin holding device located at one end wbere the main compression member is disposed and another bobbin holding device located at an opposite end. Accordingly, the compression force uniformly acts on a plurality of the elastomeric members regardless of the sliding resistances of the bobbin holding device and the cylindrical member. Thus, a plurality of bobbins can be surely held by the bobbin holder of the present invention, and noise generated by the winding apparatus is lowered because the bobbin is held coaxially with the bobbin holder, and further, the deterioration of the wound yarn quality can be prevented, and the deformation of the wound yarn package caused by the deviation of the bobbin during the winding operation can also be prevented.

BRIEF DESCRIPTION OF THE DRAWINGS

Some embodiments of the present invention will now be explained in detail with reference to the accompanying drawings, wherein:

FIG. 3(*b*) is a view shown in arrow IIIB in FIG. 3(*a*), wherein the cylindrical member is omitted;

FIG. 3(*c*) is a cross sectional view taken along line IIIC—IIIC in FIG. 3(*b*);

FIG. 8(*b*) is a view shown in arrow VIIIB in FIG. 8(*a*), wherein the cylindrical member is omitted;

FIG. 8(*c*) is a cross sectional view taken along line VIIIC—VIIIC in FIG. 8(*b*);

FIG. 12-*a* is an enlarged cross sectional view of an elastomeric member and a pulling member;

PREFERRED EMBODIMENTS

(The first embodiment)

Figure 1:
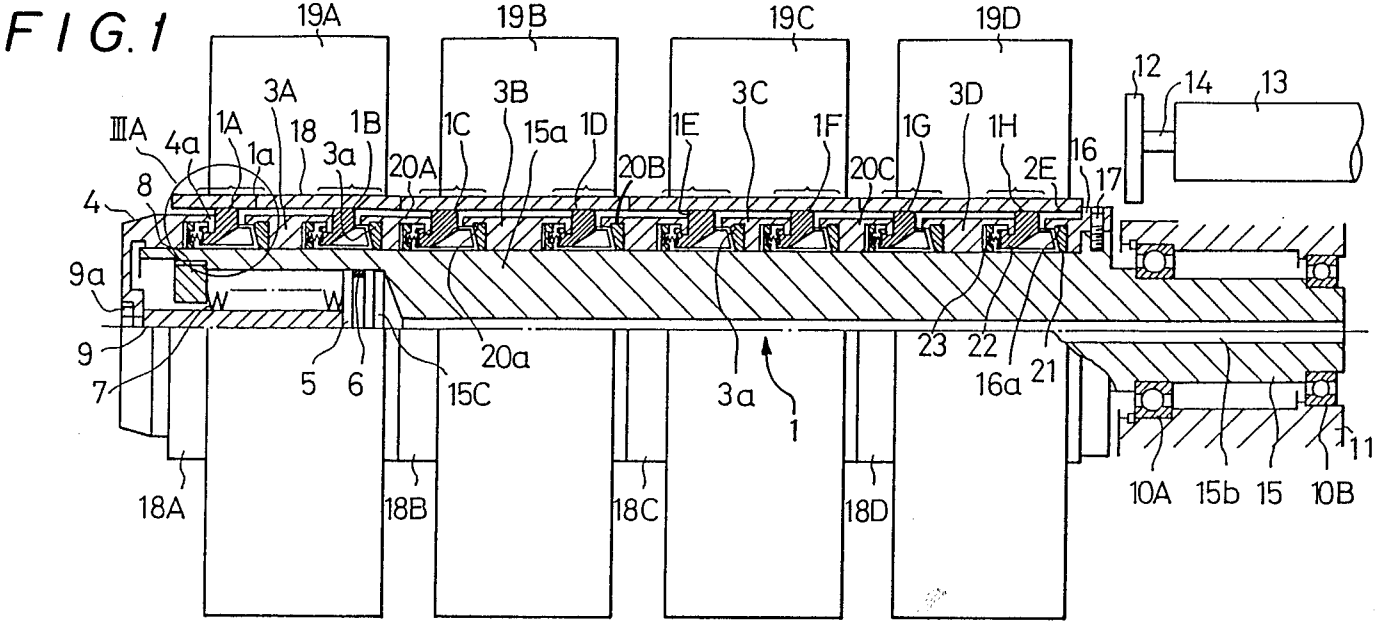
FIG. 1 is a cross sectional view of the first embodiment of the present invention, wherein bobbins are held.
Figure 2:
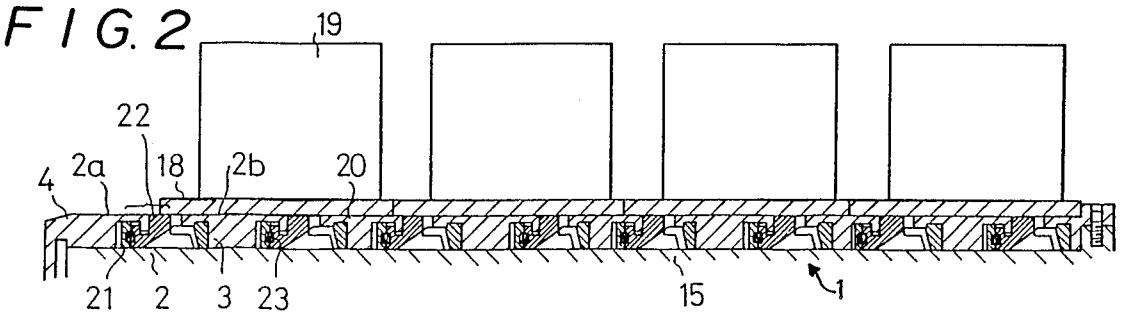
FIG. 2 is a a cross sectional view of the first embodiment of the present invention, wherein the bobbins are released.

The embodiment illustrated in FIGS. 1 and 2 is used for holding four bobbins 18. Bobbin holding devices and cylindrical members engaging with the bobbin holding devices are inserted onto a rotatable support member. The bobbin holding device comprises a first inclined member having an inner surface engaging with the rotatable support member and an outer inclined surface and a second inclined member having an inclined surface engagable with the first inclined member and an outer surface engagable with the inner surface of the bobbin. The first inclined member is substantially divided into a plurality of small pieces in a circumferential direction, and the second inclined member comprises a plurality of pieces substantially separated in a circumferential direction. The pieces of the second inclined member engage with the small pieces of the first inclined member, respectively, when the inclined surfaces are engaging with each other, whereby the first inclined member is pressed in an axial direction by means of the cylindrical member so that the bobbin holding device is expanded in a radial direction so as to hold the bobbin.

Referring to FIG. 1, the rotatable support member 15 is rotatably supported on a housing 11 of a winding apparatus by means of bearings 10A and 10B.

A cylindrical member 16 is fixed on a column portion 15*a* of the rotatable support member 15 near the housing 11 by means of a bolt 17, and from the cylindrical member 16 to the front end, a bobbin holding device 1H, a cylindrical member 3D, a bobbin holding device 1G, a cylindrical member 20C, a bobbin holding device 1F, a cylindrical member 3C, a bobbin holding device 1E, a cylindrical member 20B, a bobbin holding device 1D, a cylindrical member 3B, a bobbin holding device 1C, a cylindrical member 20A, a bobbin holding device 1B, a cylindrical member 3A and a bobbin holding device 1A are successively inserted slidably in an axial direction on the rotatable support member 15.

Figure 3:
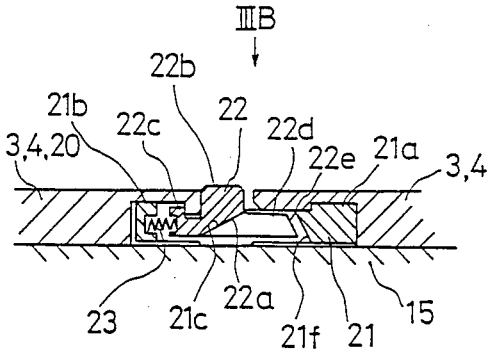
FIG. 3(*a*) is an enlarged cross sectional view of the portion IIIA in FIGS. 1 and 3(*b*), wherein the bobbin is omitted.
Figure 3:
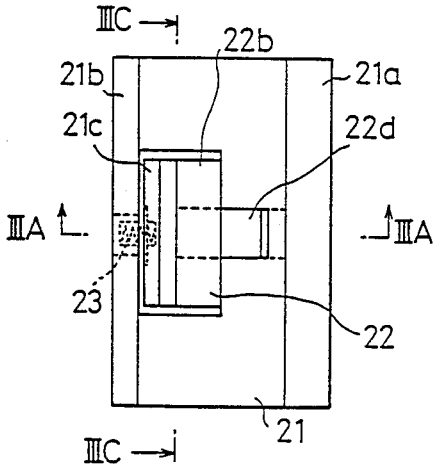
Figure 3:
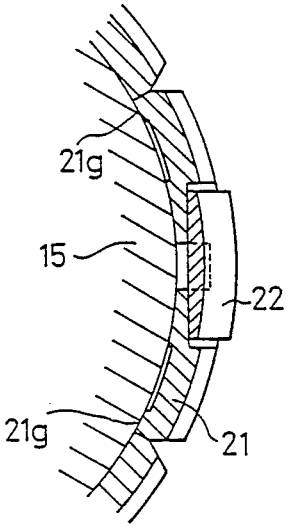

As illustrated in FIG. 3(*a*), each of the bobbin holding devices 1A to 1H is divided into six pieces in a circumferential direction.

The bobbin holding device 1 divided into six pieces comprises a first inclined member 21 engaging with the rotatable support member 15, a second inclined member 22 engagable with the inner surface of the bobbin 18 and a spring 23 axially urging the second inclined member 22. It is preferred that the material of the first and second inclined members 21 and 22 is nylon, polyurethane rubber, bakelite and so on.

Figure 4:
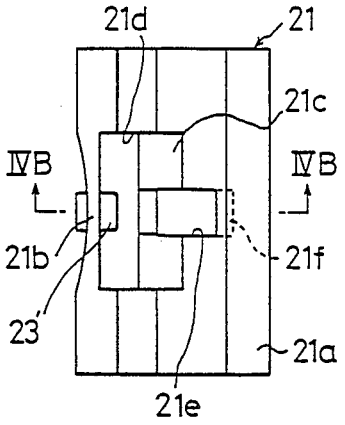
FIGS. 4(*a*)–4(*c*) illustrate a first inclined member, wherein FIG. 4(*a*) is a plan view, FIG. 4(*b*) is a view shown in arrow IVB—IVB in FIG. 4(*a*), and FIG. 4(*c*) is a left side view.
Figure 4:
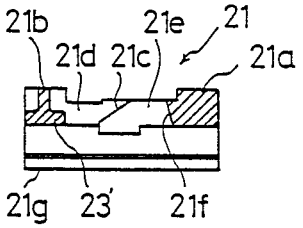
Figure 4:
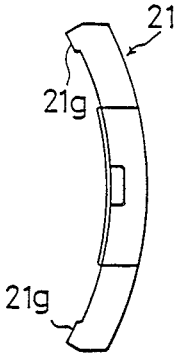

The first inclined member 21 has leg portions 21*g* formed at the bottom thereof as illustrated in FIG. 4(*c*), which portions engage with the surface of the rotatable support member 15.

As illustrated in FIGS. 3(*a*) and 4(*b*), the first inclined member 21 has flange portions 21*a* and 21*b* on the surface thereof which portions are spaced in an axial direction of the rotatable support member 15 and extend in a circumferential direction.

The flange portion 21*a* engages with the grooves 3*a*, 20*a* and 16*a*, which are formed near the left end of the inner surfaces of the cylindrical members 3A to 3D, 20A to 20C and 16, as illustrated in FIG. 1. The other flange portion 21*b* engages with the grooves formed at the other ends of the cylindrical members 3A to 3D and 4.

As illustrated in FIG. 4(*a*), a recess 21*d* of a suitable shape, such as a rectangular shape, is formed in the first inclined member 21, and a first inclined surface 21*c* is formed at the bottom of the recess 21*d*.

Figure 5:
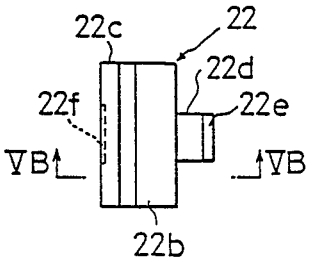
FIGS. 5(*a*)–5(*c*) illustrate a second inclined member, wherein FIG. 5(*a*) is a plan view, FIG. 5(*b*) is a view shown in arrow VB—VB in FIG. 5(*a*), and FIG. 5(*c*) is a left side view.
Figure 5:
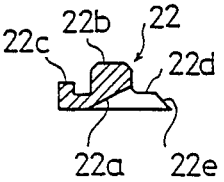
Figure 5:
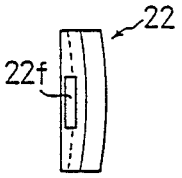

The second inclined member 22 has such an outer shape that it loosely engages with the recess 21*d* of the first inclined member 21. As illustrated in FIGS. 5(*a*) and 5(*b*), the second inclined member 22 has an outer surface 22*b* extending in a circumferential direction and engaging with the inner surface of the bobbin 18. The second inclined member 22 also has a flange portion 22*c* which receives the urging force of the spring 23. In FIGS. 4(*a*) to 4(*c*), in place of the spring which is separately prepared and which is illustrated in FIGS. 1 to 3, the flange portion 21*b* of the first inclined member 21 extends vertically and has a projection designated by reference numeral 23'. Projection 23', together with flange portion 21*b* functions as a leaf spring similar to spring 23.

As illustrated in FIG. 5(*b*), the second inclined member 22 has an inclined surface 22*a* formed at the bottom thereof which surface engages with the inclined surface 21*c* of the first inclined member 21. The flange portion 22*c* of the second inclined member 22 engages with the grooves formed at the right ends of the cylindrical members 3A to 3D, 4, and 20A to 20C as illustrated in FIGS. 1 and 2.

In FIG. 5(*a*), a plate-like projection 22*d* projects from the right side of the second inclined member 22 and has an inclined surface 22*e* formed at the front end thereof. Further, a groove 21*e*, with which the projecting portion 22*d* engages, is formed in such manner that it communicates with the recess 21*d* of the first inclined member 21, and an inclined surface 21*f* is formed at the front end of the groove 21*e*.

The projecting portion 22*d* of the second inclined member 22 engages with the recess 21*e* of the first inclined member 21, and accordingly, when the second inclined member 22 is expanded radially with no bobbin 18 inserted thereon, the second inclined member 22 is not scattered because the projecting portion 22*d* engages with the inner surface of the cylindrical member 3 or 20.

In FIG. 1, an axially extending cavity 15*c* is formed at the front end of the rotatable support member 15 to form a cylinder chamber. A piston 5 is slidably and sealingly inserted into the cylinder chamber 15*c* via an O-ring 6. A ring 8 is disposed within the cavity 15*c* of the rotatable support member 15, and coned disc springs 7 are disposed between the ring 8 and the piston 5.

Further, a cap 4 is disposed at the front end of the rotatable support member 15 in such a manner that it can move in an axial direction of the rotatable support member 15. The piston 5 and the cap 4 are connected to each other by means of a rod 9, an end of which has a nut 9*a* screwed thereon. The piston 5 is operated by compressed air which is supplied through a longitudinal hole 15*b* formed in the rotatable support member 15 and is moved in an axial direction. The cap 4 receives the force from the coned disc springs 7 via the piston 5 and compresses the first and second inclined members 21 and 22.

When the bobbins 18 are released, the cylinder chamber 15*c* is supplied with compressed air from the rear end through a longitudinal hole 15*b* in the rotatable support member 15, and the piston 5 is moved to the left in FIG. 1. Accordingly, the coned disc springs 7 are compressed and the cap 4 is moved to the left, and therefore, the inclined member 22, the flange portion 22*c* of which is engaged with the flange portion 4*a* of the cap 4, is pulled to the left. Thus, the compression spring 23 is compressed, and the distance between the cap 4 and the second inclined member 22 is kept at a predetermined value, which is determined by the distance between the flange portions 21*b* and 21*a* of the first inclined member 21. Similarly, the distances between the cylindrical members are kept at a predetermined values by means of the first inclined member 21, and the second inclined members 22 are released (see FIG. 2).

When the bobbins are held, supply of the compressed air from the rear end of the rotatable support member 15 is stopped, and the compressed air which has been in the cylinder chamber 15*c* is exhausted through the longitudinal hole 15*b* in the rotatable support member 15. Accordingly, the piston 5 is moved to the right by the spring force of the coned disc springs 7. When the piston 5 moves to the right, the cap 4 connected to the piston 5 via the rod 9 also moves to the right. Thus, the flange portion 21*b* of the first inclined member 21 is released, and the compression spring 23 extends. Accordingly, the inclined surface 22*a* of the second inclined member 22 rides on the inclined surface 21*c* of the first inclined member, 21, and the second inclined member 22 is expanded in a radial direction and holds the bobbin 18. The second inclined member 22, which has been expanded by the compression spring 23, is assisted by the coned disc springs 7, and the force for holding bobbin of the second inclined member 22 is increased.

In the first embodiment illustrated in FIGS. 1 and 2, the compression springs 23 having the same spring rigidity are used for all the bobbin holding devices 1. It is possible that the spring rigidities are increased from the front end to the rear end of the rotatable support member 15, or that the inclined angle of the inclined surfaces 21*c* and 22*a* of the first and second inclined members 21 and 22 is decreased from the front end to the rear end of the rotatable support member 15, so that the second inclined member 22 located at the rear end can be easily expanded.

According to the first embodiment of the present invention, since the inclined members which are divided in a circumferential direction are used, the force for expanding the inclined members which hold the bobbin can be small. Therefore, the force for holding a bobbin can be enlarged, and the forces for holding bobbins can be uniform from the front end to the rear end of the bobbin holder.

In addition, when bobbins are held, since the inclined surfaces of a pair of the first and second inclined members become in close contact with each other, and since the first and second inclined members are divided in a circumferential direction, the inner surface of bobbin holding device becomes in close contact with the rotatable support member. Accordingly, there occurs no clearance between the bobbin holding devices and the rotatable support member. Therefore, small vibration is not generated during the winding operation, and the rotatable support member and the cylindrical member are not clogged or damaged due to the small vibration. Thus, the vibration during the winding operation is prevented, and safety during the winding operation increases. Further, the quality of the obtained yarn becomes high.

In the above-described embodiment, a compression spring 23 is disposed between a pair of the first and second inclined members. However, the compression spring may be replaced by a coil spring, a coned disc spring, a wave washer, a leaf spring, a torsion spring, a rubber or the like, or a part of the first inclined member may be used as a spring member as illustrated in FIG. 4.

(The second embodiment)

Further, in the above-described embodiment, the compression springs 23 are disposed at all the portions between the first and second inclined members. However, in some cases it is sufficient that one or more supplementary compression member which supplements the main compression member, such as the coned disc springs 7, may be disposed at a part of portions between the front end where the main compression member is disposed and the rear end which is opposite to the front end. In this case, the number of the supplementary compression members is less than that of the bobbin holding devices.

The second embodiment of this type according to the present invention will now be explained with reference to FIGS. 6 to 9. The parts same as or similar to those described with reference to the above-described first embodiment will be designated with the same reference numerals, and their further explanation is omitted. The differences between the first embodiment and the second embodiment will now be explained.

Since the compression springs 23 are not disposed at all the portions between the first inclined member and the second inclined member, one end of the recess formed in the second inclined member 22 of the present embodiment is open.

In this second embodiment, a supplementary compression member of the present invention is disposed at the cylindrical member 20C. More specifically, a spring retainer 24 is fixed to the rotatable support member 15 by a set screw 24*a*. The spring retainer has a recess aligned with the axial direction of the rotatable support member 15. A compression spring 23 is disposed between the recess and the cylindrical member 20C.

In addition, like the first embodiment, the front end of the rotatable support member 15 has a cap 4 mounted thereon movably in an axial direction thereof, which cap receives the force from the coned disc springs 7 and pressed the first and second inclined members 21 and 22. The piston 5 and the cap 4 are connected to each other by a rod 9, front end of which has a nut 9*a* screwed thereon. The piston 5 is operated by compressed air supplied through a longitudinal hole 15*b* formed in the rotatable support member 15 and is moved in a axial direction.

Figure 6:
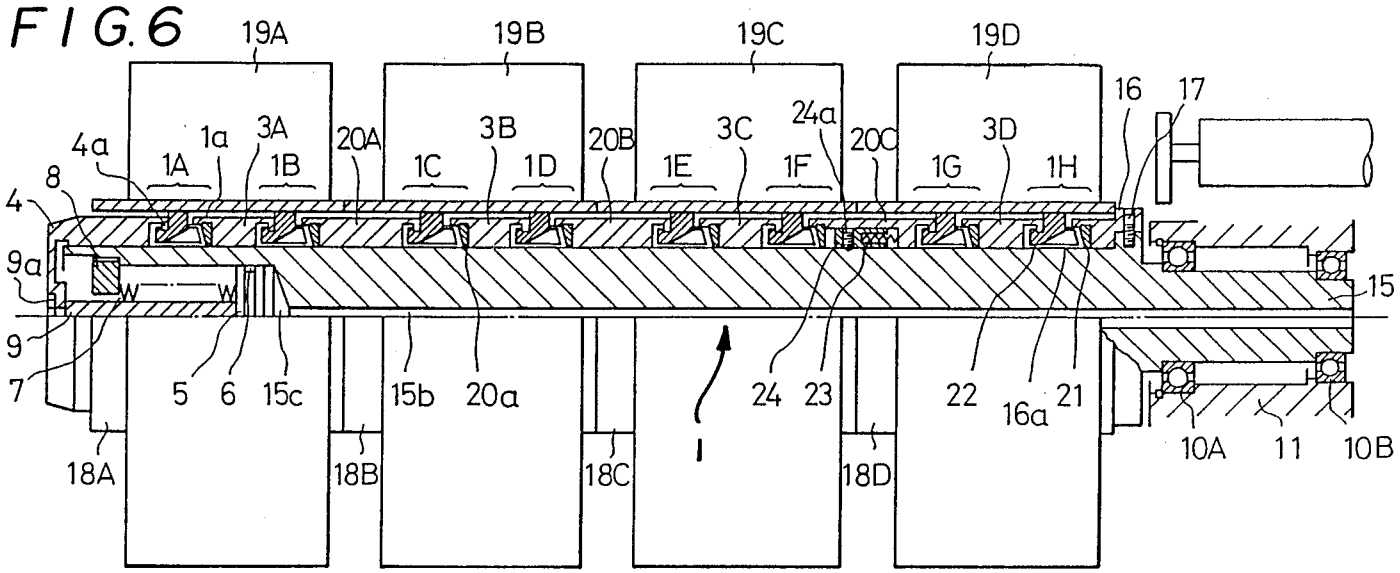
FIG. 6 is a cross sectional view of the second embodiment of the present invention, wherein bobbins are held.
Figure 7:
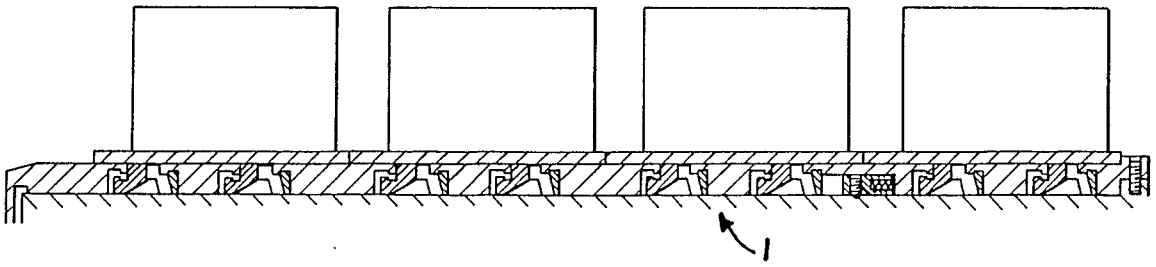
FIG. 7 is a cross sectional view of the second embodiment of the present invention, wherein the bobbins are released.
Figure 8:
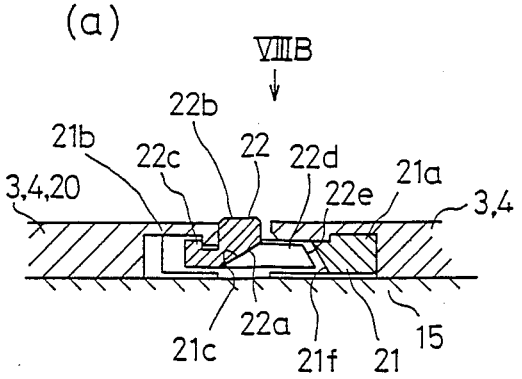
FIG. 8(*a*) is an enlarged cross sectional view of the portion VIIIA in FIG. 8(*b*), wherein the bobbin is omitted.
Figure 8:
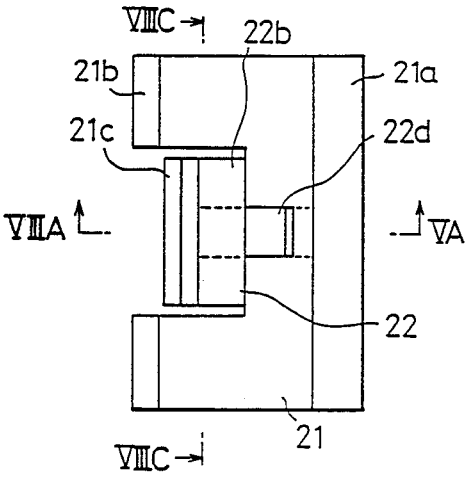
Figure 8:
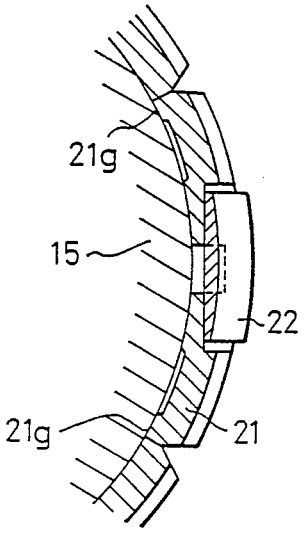
Figure 9:
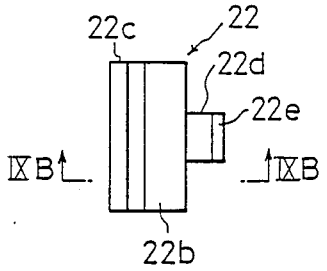
FIGS. 9(*a*)–9(*c*) illustrate a second inclined member, wherein FIG. 9(*a*) is a plan view, FIG. 9(*b*) is a view shown in arrow IXB—IXB in FIG. 9(*a*), and FIG. 9(*c*) is a left side view.
Figure 9:
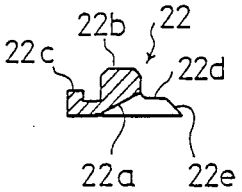
Figure 9:
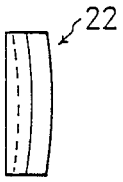
Figure 9:
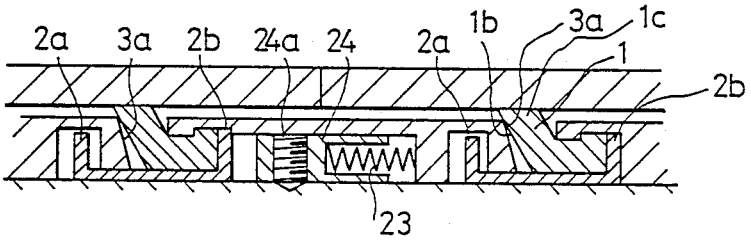

When the bobbins 18 are released, compressed air is supplied from the rear end through a longitudinal hole 15*b* in the rotatable support member 15 and enters into the cylinder chamber 15*c* so that the piston 5 is moved to the left in FIG. 6. Accordingly, the coned disc springs 7 are compressed and the cap 4 is moved to the left, and therefore, the inclined member 22, the flange portion 22*c* of which is engaged with the flange portion 4*a* of the cap 4, is pulled to the left. Thus, the compression spring 23 is compressed, and the distance between the cap 4 and the second inclined member 22 is kept at a predetermined value, which is determined by the distance between the flange portions 21*b* and 21*a* of the first inclined member 21. Similarly, the distances between the cylindrical members are kept at a predetermined values by means of the first inclined member 21, and the second inclined members 22 are released (see FIG. 7).

When the bobbins are held, supply of the compressed air from the rear end of the rotatable support member 15 is stopped, and the compressed air which has been in the cylinder chamber 15*c* is exhausted through the longitudinal hole 15*b* in the rotatable support member 15. Accordingly, the piston 5 is moved to the right by the spring force of the coned disc springs 7. When the piston 5 moves to the right, the cap 4 connected to the piston 5 via the rod 9 also moves to the right because of the movement of the coned disc springs 7. Thus, the flange portion 21*b* of the first inclined member 21 is released, and the compression spring 23 extends. Accordingly, the inclined surface 22*a* of the second inclined member 22 rides on the inclined surface 21*c* of the first inclined member 21A, and the second inclined member 22 is expanded in radial directions and holds the bobbin 18. The second inclined member 22, which has been expanded by the coned disc springs 7, is assisted by the compression spring 23, and decrease of the force for holding bobbin at the rear end is compensated.

Figure 10:
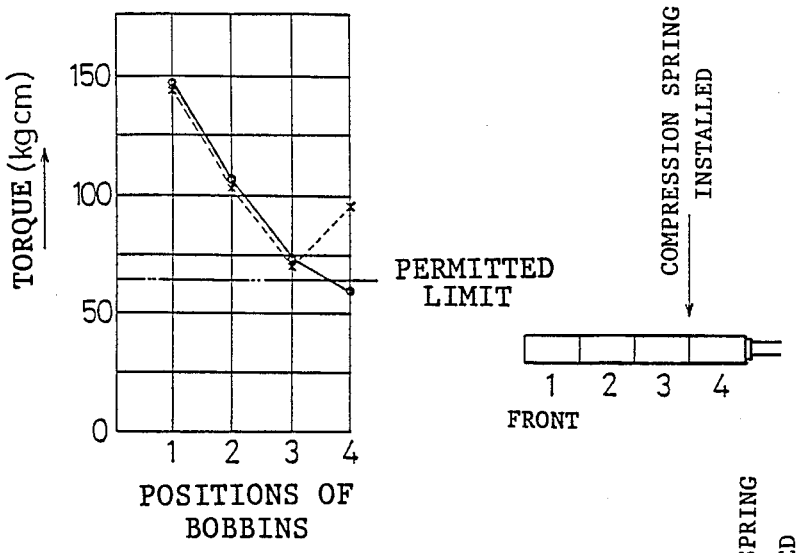
FIG. 10 is a diagram illustrating the relationship between the positions of the bobbins and the bobbin holding force in a bobbin holder for holding four bobbins.
Figure 11:
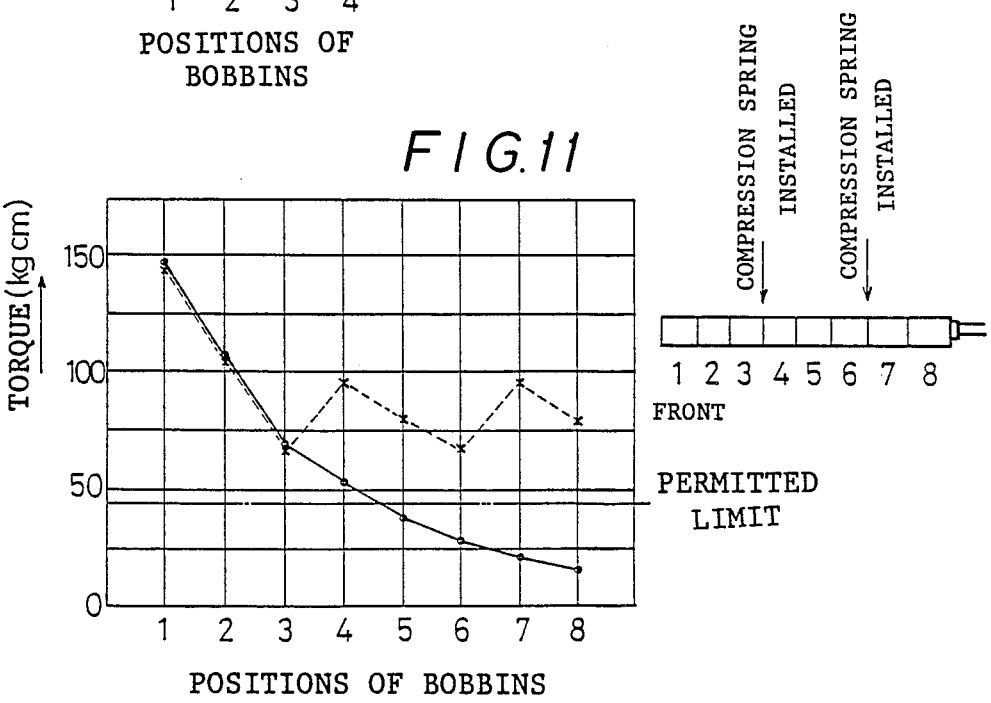
FIG. 11 is a diagram illustrating the relationship between the positions of the bobbins and the bobbin holding force in a bobbin holder for holding eight bobbins.

FIGS. 10 and 11 are diagram which illustrate the relationship between the positions of the bobbins and the bobbin holding force according to the second embodiment illustrated in FIGS. 6 to 9. The bobbin holding force was measured as torque required for turning a bobbin, side surfaces of which are not in contact with the adjacent bobbins. In FIGS. 10 and 11, solid line shows the results of a conventional bobbin holder, and a broken line shows the bobbin holding force of the present invention.

Four bobbins are held in FIG. 10, and eight bobbins are held in FIG. 11, and further, the positions of supplementary compression members are designated.

According to the conventional bobbin holder, as shown by the solid lines in FIGS. 10 and 11, the bobbin holding force, i.e., the measured torque, uniformly decreases from the front end to the rear end of the bobbin holder. The bobbin holding force is less than the permitted limit at the bobbins near rear end, especially, at the fourth bobbin in FIG. 10 and at the fourth to eighth bobbins in FIG. 11.

Contrary to this, according to the present invention, the bobbin holding force exceeds the permitted limit at any bobbins located near front end to the rear end. Thus, the bobbins are surely held. Therefore, vibration does not occur during the winding operation, and deformation of the wound package due to the vibration is prevented. Further, noise generated by the winding apparatus can be small, and life of the bearings supporting the rotatable support member can be long. Besides, the winding apparatus becomes more safe and the yarn with high quality can be wound.

According to the second embodiment, in addition to the advantages obtained by the first embodiment, the following advantages can be achieved.

As described above, in the present embodiment, a main compression member which radially expands the bobbin holding devices is disposed at one end, and at least one supplementary compression member which supplements the radial expansion force of the main compression member is disposed at an intermediate portion of the rotatable support member in such a manner that it engages with the rotatable support member and the cylindrical member. Accordingly, the bobbin holder of this embodiment is not influenced by the sliding resistances of the bobbin holding devices and cylindrical members. Therefore, relatively uniform forces act on a plurality of bobbin holding devices, and bobbins are securely held. Thus, the bobbins held by the bobbin holder become concentric with the rotatable support member, and the noise level becomes low. Noise generated by the winding apparatus becomes small, deformation of wound package due to the deviation thereof is prevented, and deterioration of the yarn quality due to the vibration can be prevented.

According to the present embodiment, the relatively large main compression member is disposed at the front end of the rotatable support member, while relatively small supplementary compression members are disposed at the intermediate portion of the rotatable support member, and therefore the diameter of the bobbin holder can be small.

In the above-described first and second embodiments, both the first and second inclined members are completely divided in the circumferential direction, however, one or both of the first and second inclined members may be connected at a part of circumference thereof as long as the movement thereof is not prevented.

(Third embodiment)

The third embodiment is an alteration of the above-described second embodiment and will now be explained with reference to FIGS. 12 and 13.

Figure 12:
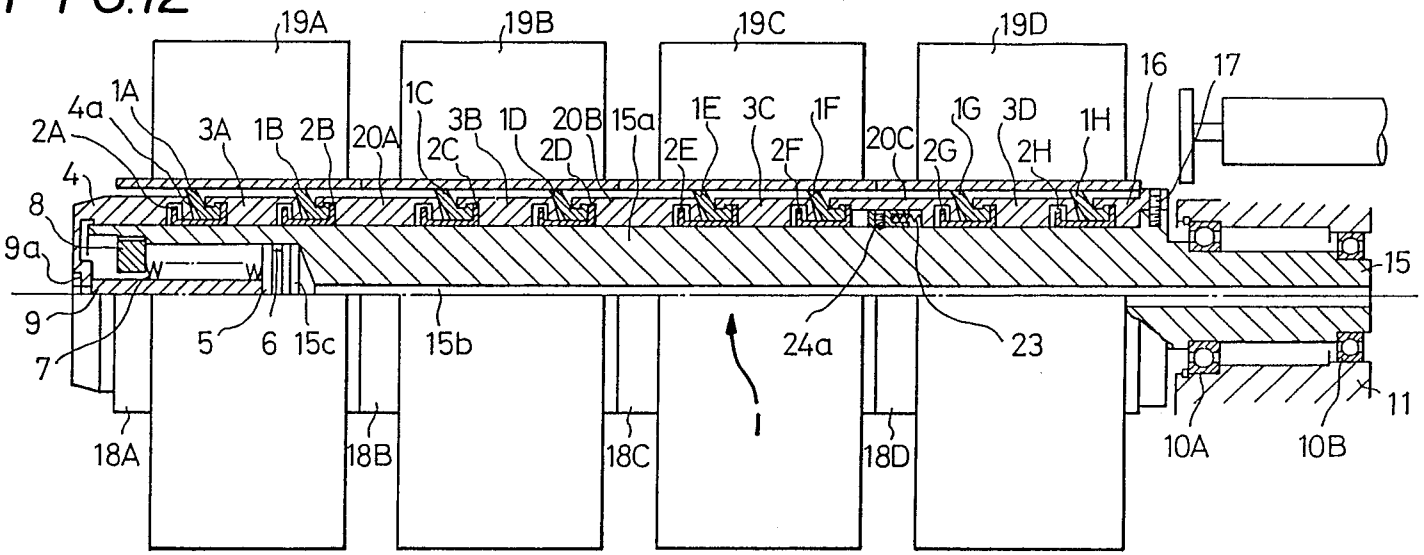
FIG. 12 is a cross sectional view of the third embodiment of the present invention, wherein bobbins are held.
Figure 13:
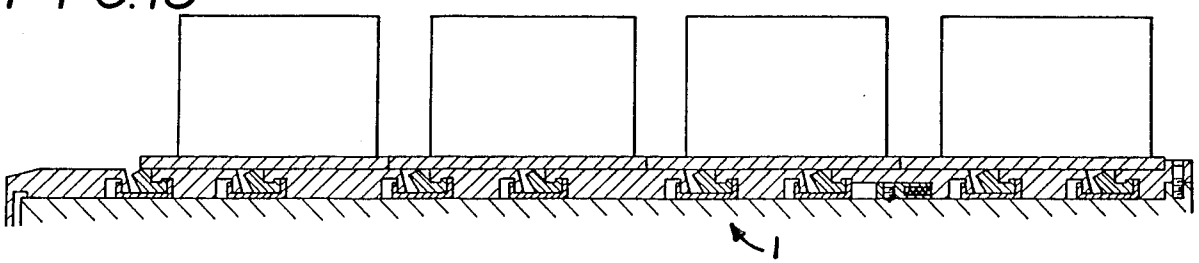
FIG. 13 is a cross sectional view of the third embodiment of the present invention, wherein bobbins are released.

Referring to FIG. 12, the rotatable support member 15 is rotatably supported on a housing 11 of a winding apparatus by means of bearings 10A and 10B.

A cylindrical member 16 is fixed on a column portion 15*a* of the rotatable support member 15 near the housing by means of a bolt 17, and successively inserted slidably in an axial direction on the rotatable support member 15 from the cylindrical member 16 to the front end are an elastomeric member 1H, a cylindrical member 3D, an elastomeric member 1G, a cylindrical member 20C, an elastomeric member 1F, a cylindrical member 3C, an elastomeric member 1E, a cylindrical member 20B, an elastomeric member 1D, a cylindrical member 3B, an elastomeric member 1C, a cylindrical member 20A, an elastomeric member 1B, a cylindrical member 3A and an elastomeric member 1A.

The elastomeric members 1A to 1H of the present embodiment is the bobbin holding devices of the present invention. Each bobbin holding device 1A to 1H has a U-shape portion formed at the base thereof, which engages with an L-shaped groove formed at one end of each of cylindrical members 3A to 3D, 20A to 20C and 16.

When bobbins are held, a shoulder portion 1*b* of the elastomeric member 1 and coned portion 3*a*, 20*a* or 4*a* of the cylindrical member 3, 20 or the cap 4 engage with each other as illustrated in FIG. 12-*a*, and the elastomeric member 1 is radially and outwardly expanded by means of the compression force axially acting on the elastomeric member 1. The peripheral surface 1*c* located at the end of the coned portion of the elastomeric member 1 engages with the inner surface of the bobbin 18 and holds the bobbin 18.

Pulling members 2A to 2E are disposed slidably along the column portion 15*a* of the rotatable support member 15 and coaxially with the elastomeric members 1A to 1H in such a manner that the pulling members 2A to 2E engage with the grooves formed at the inside of the elastomeric members 1A to 1H. More specifically, each of the pulling members 2A to 2E has a U-shape cross section as illustrated in FIG. 12-*a*, and its flange portion 2*b* is inserted into a space between the axial outer surface of the U-shaped portion of each of the elastomeric members 1A to 1H and the groove formed at the inside of each of the elastomeric members 1A to 1H.

The other flange portion 2*a* of each of the pulling members 2A to 2E is axially slidably inserted into an annular groove formed on the inner surface of each of the cylindrical members 3A to 3D, and 20A to 20C. The pulling members 2A to 2H are divided into three pieces in the circumferential direction.

Referring to FIG. 12-*a*, the supplementary compression member of the present invention disposed on the cylindrical member 20C will now be explained.

A spring retainer 24 is fixed to the rotatable support member 15 by a set screw 24*a*. The spring retainer has a recess aligned with the axial direction of the rotatable support member 15. A compression spring 23 is disposed between the recess and the cylindrical member 20C so that the compression spring 23 urges the elastomeric members 1G and 1H via the cylindrical member 20C so as to compress the elastomeric members 1G and 1H.

An axially extending cavity 15*c* is formed at the front end of the rotatable support member 15 to form a cylinder chamber. A piston 5 is slidably and sealingly inserted into the cylinder chamber 15*c* via an O-ring 6. A ring 8 is threaded within the cavity 15*c* of the rotatable support member 15, and coned disc springs 7 are disposed between the ring 8 and the piston 5.

Further, a cap 4 is disposed at the front end of the rotatable support member 15 in such a manner that it can move in an axial direction of the rotatable support member 15. The piston 5 and the cap 4 are connected to each other by means of a rod 9, an end of which has a nut 9*a* screwed thereon. The piston 5 is operated by compressed air which is supplied through a longitudinal hole 15*b* formed in the rotatable support member 15 and is moved in an axial direction. The cap 4 receives the force from the coned disc springs 7 via the piston 5 and compress the first and second inclined members 21 and 22. The main compression member of the present invention is constructed as described above.

When holding of the bobbins 18 is released, the cylinder chamber 15*c* is supplied with compressed air from the rear end through a longitudinal hole 15*b* in the rotatable support member 15, and the piston 5 is moved to the left in FIG. 12. Accordingly, the coned disc springs 7 are compressed, and the cap 4 is also moved to the left, and therefore, the cylindrical member 3A, engaging with the flange portion 2*a* of the pulling member 2A, is pulled to the left, and thus, the distance between the cap 4 and the cylindrical member 3A is kept at a value predetermined by the distance between the flange portions 2*a* and 2*b* of the pulling member 2A. Similarly, the distances between the cylindrical members are successively kept at a predetermined value by the pulling members 2A, and the elastomeric members 1A to 1F are released.

When the elastomeric member 1F is released, the cylindrical member 20C is pulled by means of the pulling member 2F, which is successively released from the front end. Thus, the compression spring 23 is compressed, and the pulling member 2G is pulled, and the elastomeric member 1G is released. Similarly, the elastomeric member 1H is also released (see FIG. 13).

When the bobbins are held, supply of the compressed air from the rear end of the rotatable support member 15 is stopped, and the compressed air which has been in the cylinder chamber 15*c* is exhausted through the longitudinal hole 15*b* in the rotatable support member 15. Accordingly, the piston 5 is moved to the right by the spring force of the coned disc springs 7. When the piston 5 moves to the right, the cap 4 connected to the piston 5 via the rod 9 also moves to the right due to the expansion of the coned disc springs 7. Thus, the pulling member 2 is released. At the same time, the elastomeric members 1A to 1H are successively compressed, and the compression spring 23 extends. Accordingly, the elastomeric members 1G to 1H are compressed, and the elastomeric members 1A to 1H are radially expanded. Thus, the inner surfaces of the bobbins are held by the elastomeric member 1A to 1H. The elastomeric members, which has been expanded by the coned disc springs 7, are further compressed by the compression spring 23, and decrease of the force for holding bobbin at the rear end is compensated.

In the above-described third embodiment, all the elastomeric member are of the same size. However, the sizes of the elastomeric members may be changed depending on the positions where the elastomeric members are disposed so that the mechanical characters of the elastomeric member may be changed.

Further, in the above-described second and third embodiments, the compression spring 23 is disposed at only one portion. However, the number of the compression springs 23 may be increased as long as it is less than the number of the bobbin holding device. In this case, the spring rigidities of the compression coil springs 23 may be of the same or may be increased from the front end to the rear end of the rotatable support member 15.

Although the bobbin holder of the present embodiment holds four bobbins, the number of the bobbins is not limited.

Further, the position where the compression spring is disposed is suitably selected taking into consideration the required chucking force of the bobbin holder.

The shape of the elastomeric member is not limited to that described above and illustrated in the accompanying drawings, and other shapes can be used, for example, cylindrical shape, L-shaped cross section, X-shaped cross section, reverse V-shape cross section.

Although in the above-describe embodiment, the compression coil spring 23 is disposed, a tension coil spring, a coned disc spring, a wave washer, a leaf spring, a torsion spring, a rubber or the like may be used in place of the compression coil spring.

According to the third embodiment, like the above-described second embodiment, a main compression member which radially expands the bobbin holding devices is disposed at one end, and at least one supplementary compression member which supplements the radial expansion force of the main compression member is disposed at an intermediate portion of the rotatable support member in such a manner that it engages with the rotatable support member and the cylindrical member. Accordingly, the bobbin holder of this embodiment is not influenced by the sliding resistances of the bobbin holding devices and cylindrical members. Therefore, relatively uniform forces act on a plurality of bobbin holding devices, and bobbins are securely held. Thus, the bobbins held by the bobbin holder become concentric with the rotatable support member, and the noise level becomes low. Noise generated by the winding apparatus becomes small, deformation of wound package due to the deviation thereof is prevented, and deterioration of the yarn quality due to the vibration can be prevented.

According to the this third embodiment, the relatively large main compression member is disposed at the front end of the rotatable support member, while relatively small supplementary compression members are disposed at the intermediate portion of the rotatable support member, and the diameter of the bobbin holder can be small.

(Other embodiments)

According to the present invention, the bobbin holding device can be constructed in accordance with the teachings of the first and second embodiments while the force of the compression member can be transmitted by the pulling members as illustrated in the third embodiment.

More specifically, the bobbin holding device comprises a first inclined member which has an inner surface engaging with the rotatable support member and an inclined outer surface and a second inclined member which has an inclined surface engaging with the first inclined member and an outer surface engaging with an inner surface of a bobbin.

Figure 14:
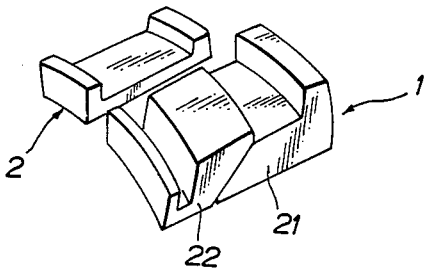
FIG. 14 is a partial perspective view of an elastomeric member and a pulling member of another embodiment of the present invention.

In this case, the pulling member may be separated from the bobbin holding device 1 which comprises the first inclined member 21 and the second inclined member 22 as illustrated in FIG. 14, or may be constructed in one body.

Figure 15:
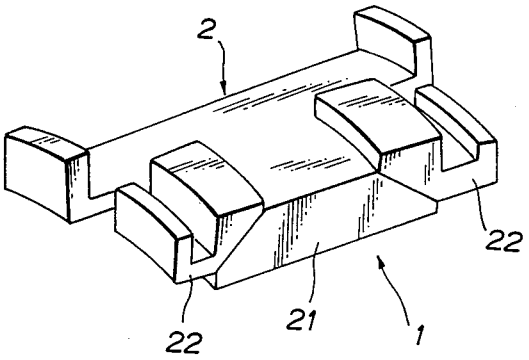
FIG. 15 is a partial perspective view of an elastomeric member and a pulling member of still another embodiment of the present invention.

Further, as illustrated in FIG. 15, inclined surfaces may be formed at both the sides of the first inclined member 21 corresponding to two bobbin holding devices, and each the inclined surface engages with the second inclined member 22. In FIG. 15, the pulling member 2 is formed in one body with the first inclined member 21.

The following advantages can be achieved by a bobbin holder according to the present invention.

The bobbin holder can surely hold a bobbin, can be free from vibration and deformation of a yarn package during the winding operation, can lower the noise, can prolong the life of bearings supporting a rotatable support member, can be operated in safety and can wind a yarn with high quality.

What is claimed is:

1. A bobbin holder which comprises a rotatable support member, devices for holding bobbins, and cylindrical members engaging with said bobbin holding devices, said bobbin holding devices and said cylindrical members being alternately inserted onto said rotatable support member, each of said cylindrical members having grooves formed at inner surfaces thereof near longitudinal ends thereof, each of said bobbin holding devices comprising:

a first inclined member which has an inner surface engaging with said rotatable support member, an inclined outer surface and flange portions formed at ends thereof for engaging with grooves formed at adjacent ends of said cylindrical members; and a second inclined member which has an inclined surface engaging with said first inclined member, an outer surface engaging with an inner surface of a bobbin, and a flange portion formed at an end opposite to said inclined surface thereof and engaging with one of the grooves of said cylindrical members, said first inclined member being substantially divided into a plurality of small pieces in a circumferential direction, said second inclined member comprising a plurality of pieces substantially separated in a circumferential direction, and said pieces of said second inclined member engaging with said small pieces of said first inclined member, respectively, when said inclined surfaces are engaged with each other.

2. A bobbin holder which comprises a rotatable support member, a plurality of devices, inserted onto said rotatable support member, for holding bobbins, and at least one cylindrical member inserted onto said rotatable support member and engaging with said bobbin holding devices, said bobbin holding devices are radially expanded so as to hold bobbins, wherein:

a main compression member for radially expanding said bobbin holding devices is disposed at one end of said bobbin holder, at least one supplementary compression member for supplementing radial expansion force of said main compression member is disposed at an intermediate portion of said bobbin holder between a bobbin holding device located at said end where said main compression member is disposed and another bobbin holding device located at an opposite end of said bobbin holder, and the number of said supplementary compression members is less than, or equal to, that of said bobbin holding devices.

3. A bobbin holder which comprises a rotatable support member, a plurality of devices, inserted onto said rotatable support member, for holding bobbins, and cylindrical members inserted onto said rotatable support member and engaging with said bobbin holding devices, said bobbin holding devices are radially expanded so as to hold bobbins, said bobbin holding devices and said cylindrical members being alternately inserted onto said rotatable support member, wherein:

a main compression member for radially expanding said bobbin holding devices is disposed at one end of said bobbin holder;

at least one supplementary compression member for supplementing radial expansion force of said main compression member is disposed at an intermediate portion of said bobbin holder between a bobbin holding device located at said end of said bobbin holder where said main compression member is disposed, and another bobbin holding device located at an opposite end of said bobbin holder; and the number of said supplementary compression members is less than, or equal to, that of said bobbin holding devices;

each of said cylindrical members having grooves formed at inner surfaces thereof near longitudinal ends thereof;

each of said bobbin holding devices comprises:

a first inclined member which has an inner surface engaging with said rotatable support member, an inclined outer surface and flange portions formed at ends thereof for engaging with grooves formed at adjacent ends of said cylindrical members; and a second inclined member which has an inclined surface engaging with said first inclined member, an outer surface engaging with an inner surface of a bobbin, and a flange portion formed at an end opposite to said inclined surface thereof and engaging with one of the grooves of said cylindrical members;

said first inclined member is substantially divided into a plurality of small pieces in a circumferential direction, said second inclined member comprises a plurality of pieces substantially separated in a circumferential direction, and said pieces of said second inclined member engaging with said small pieces of said first inclined member, respectively, when said inclined surfaces are engaged with each other.

* * * * *